US006158587A

United States Patent [19]

Emery

[11] Patent Number: 6,158,587

[45] Date of Patent: Dec. 12, 2000

[54] EXPANDABLE TAPERED SLEEVES

[76] Inventor: Roy William Emery, 1 Donino Court, Toronto, Ontario, Canada, M4N 2H6

[21] Appl. No.: 09/369,379

[22] Filed: Aug. 6, 1999

[51] Int. Cl.[7] ..... B65D 81/05

[52] U.S. Cl. ..... 206/427; 206/446; 206/563; 229/407

[58] Field of Search ..... 47/39, 84, 86; 206/150, 151, 158, 193, 199, 562, 563, 427, 446, 486; 211/71.01, 72, 74; 220/23.2, 23.4, 23.6, 23.8, 507–509, 516–518; 229/932, 406, 407; 428/131, 134

[56] References Cited

U.S. PATENT DOCUMENTS

| | | | |
|---|---|---|---|
| 809,854 | 1/1906 | Sochurek, Sr. | 206/199 |
| 1,396,269 | 11/1921 | Eckart | 428/134 |
| 1,616,570 | 2/1927 | Boynton | 229/932 |
| 2,948,452 | 8/1960 | Grogan et al. | 229/932 |
| 3,115,266 | 12/1963 | Poupitch | 220/23.6 |
| 3,501,044 | 3/1970 | Stone | 220/23.4 |
| 4,823,959 | 4/1989 | Bixler | 206/562 |
| 5,409,127 | 4/1995 | Stratford | 220/23.4 |

*Primary Examiner*—Jim Foster

[57] ABSTRACT

Resiliently expandable sleeves to locate and protectively separate from each other bottles or other articles placed vertically in a container are each comprised of at least three side walls connected to each other at their adjacent edges, each said side wall being tapered from the width at its upper edge to a lesser width at its lower end, the dimensions of the opening at the top of each said sleeve formed by said upper edges being designed to provide free entry of said article into said tapered sleeve, with further insertion of said article into said sleeve causing each of said side walls to be resiliently deflected outwardly, thereby to create a grasping pressure over the area of contact between the outer surface of said article, and the inner surface of each of said side walls.

5 Claims, 8 Drawing Sheets

EXPANDABLE TAPERED SLEEVES

FIELD OF THE INVENTION

Resiliently expandable sleeves, tapered for nestability in storage, serve as protective separators for articles placed vertically in a container.

PRIOR ART

Various methods for protective separation of bottles placed vertically in a container include simple strips of paperboard placed between bottles, or moulded devices for positioning bottles at their tops and bottoms as described in U.S. Pat. No. 4,625,908 (Emery, 1986) and accordion folded packaging, as described in U.S. Pat. No. 4,485,610 (Galley et al, 1984) and U.S. Pat. No. 5,379,946 (Emery, 1995).

SUMMARY OF THE INVENTION

It is the object of this invention to create a tapered resiliently expandable soft moulded pulp sleeve with which to enwrap the circumference of each one of a multiplicity of bottles or other fragile articles of similar shape and dimensions placed vertically and closely spaced together in a container. For maximum expandability to the shape and dimension of each said article, said sleeve as formed is comprised of three, or the preferred four side walls, according to the arrangement of said articles within the container, each of said side walls in each said sleeve being of similar shape and dimensions. To facilitate unmoulding in the manufacturing process, and nestability in multiple storage, each of said sleeves as formed is tapered from a larger opening at its upper end which allows free entry of the article to be entered therein, to a smaller dimension at the opposite end thereof, and in the preferred embodiments of this invention each of said sleeves is comprised of four side walls connected together at a predetermined portion of their adjacent edges, each of said side walls being tapered in width symmetrically and sufficiently to provide a downwardly and inwardly slope in each portion of said side walls to guarantee free movement in denesting from multiple storage. And each of said side walls of each said sleeve is designed to be deflected outwardly of said sleeve by the further entry of said article, to accommodate the size and shape of said article in the areas of contact therewith at that point in the taper of said sleeve, thereby creating a clasping pressure of said side walls upon the exterior of said article. The resilient outwardly expansion of said side walls will permit the further insertion of said article along the length of said sleeve only to the point where the total connected internal circumference of said four side walls is approximately equal to, but not less than, the circumference required to accommodate the size and shape of the article to be contained therein. Because of the degree of taper created by the angle of slope, preferably one part horizontally in four parts of vertical height, to accommodate the soft moulded side walls, a longer length of sleeve is required, to continue beyond that point with continuing taper and compensating details, including discontinuation of the connections between said adjacent edges of said side walls, will be required to permit the further entry of said article.

A first preferred embodiment of the invention is a group comprised of a multiplicity of said sleeves, each said sleeve being comprised of four tapered planar side walls of identical shape and size connected together at their adjacent edges with their wider upper edges forming the rim of a square opening at the upper end of each said sleeve, each side of said opening having a width equal to the diameter of a cylindrical glass bottle to provide free entry thereof at that level. Each said sleeve is tapered to smaller dimensions at its lower end, each said side wall thereof being tapered accordingly to a smaller width at its lower end. Said multiplicity of sleeves are connected together at the adjacent upper edges of their respective side walls to form an interconnected group arranged in rows to conform with the dimensions of the intended container. The connections between the adjacent side walls of each of said sleeves of said group are discontinued beyond a predetermined point in the length of each said sleeve where the sum total of the widths of said four side walls of said sleeve is becoming less than the circumference of said cylindrical glass bottle to be contained therein, thereby allowing the further outwardly deflection of the remaining lower portion of each of said side walls required to permit the entry of said bottle to the full length of said sleeve.

In a second preferred embodiment of the invention, in another group comprised of a multiplicity of said sleeves, each said sleeve in said group is tapered sufficiently to provide nestability in storage, and each of its four tapered side walls is formed with a tapered depression projecting inwardly of said sleeve and extending along the length thereof, tapering from a minimum dimension at or close to the upper edge of each said side wall and increasing in depth and width to a larger dimension at the opposite end thereof, thereby providing for an increase in effective width of each said side wall relating in its extent to the dimensions of said depression at each point in the length thereof, and to the extent of the outward deflection of said depression caused by the entry of the article to be contained therein.

In a third preferred embodiment a group of 12 bottles in a 24 pack container are entered into a corresponding interconnected group of 12 of said sleeves, and retained in place at their top ends by a reinforced panel of 12 interconnected tapered cells, each of said panels having reinforcing ribs with glue faces for attachment to the inner face of the corresponding inner cover flaps of said container.

DETAILED DESCRIPTION OF THE EMBODIMENTS

Figure 1:
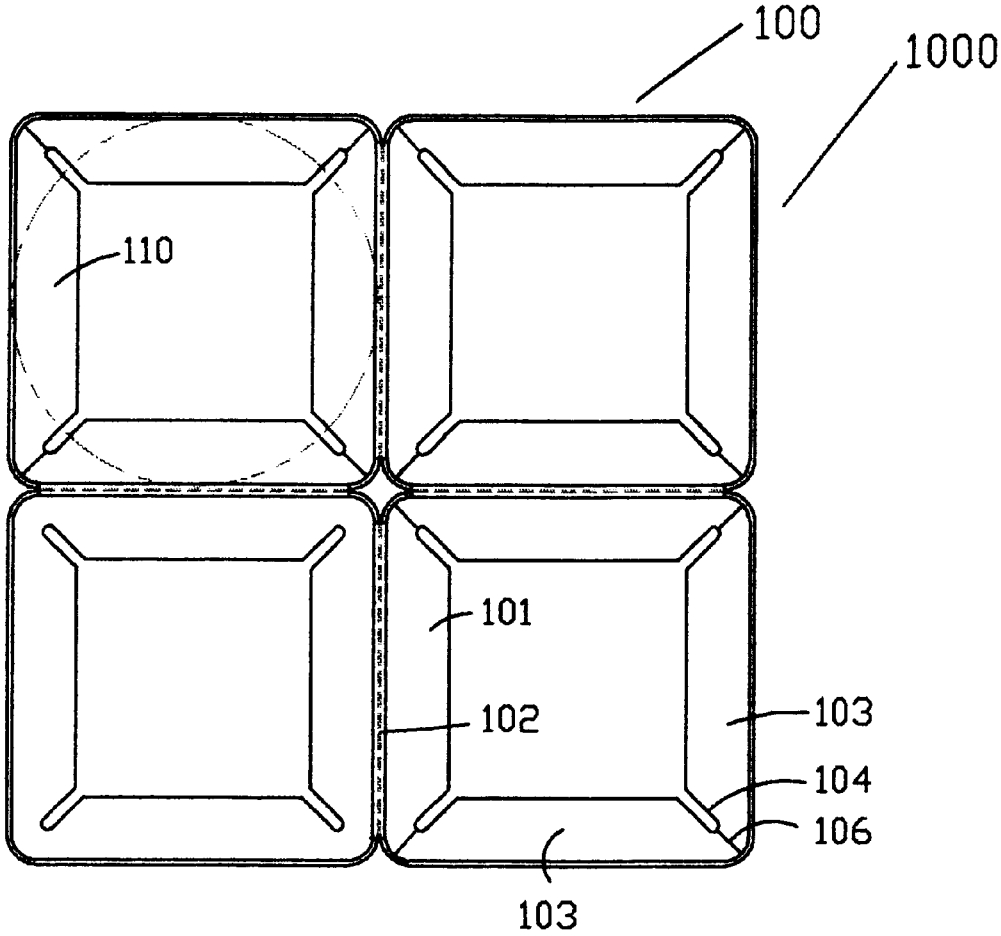
FIG. 1 is a plan view of an interconnected group of 4 tapered sleeves designed to protect and retain in position 4 short bottles placed vertically in a container.
Figure 2:
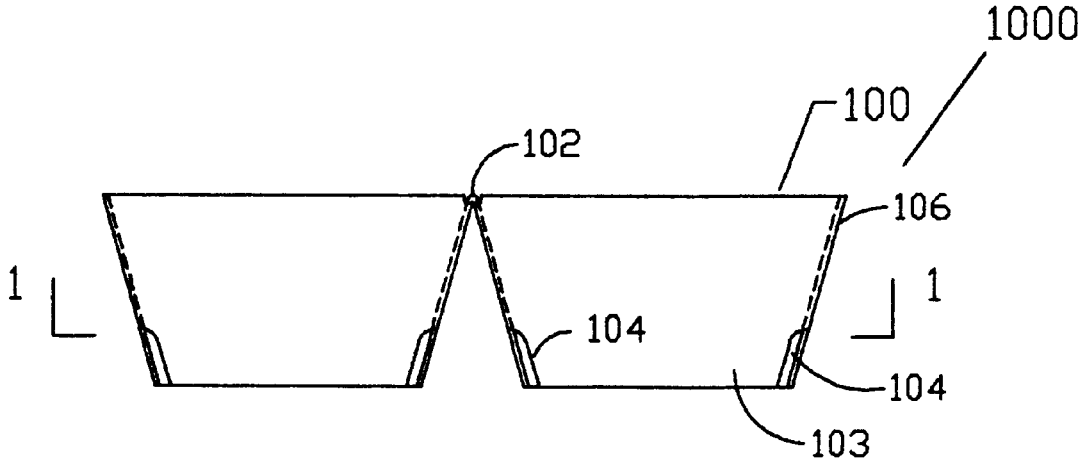
FIG. 2 is an end view of said group of sleeves of FIG. 1.
Figure 3:
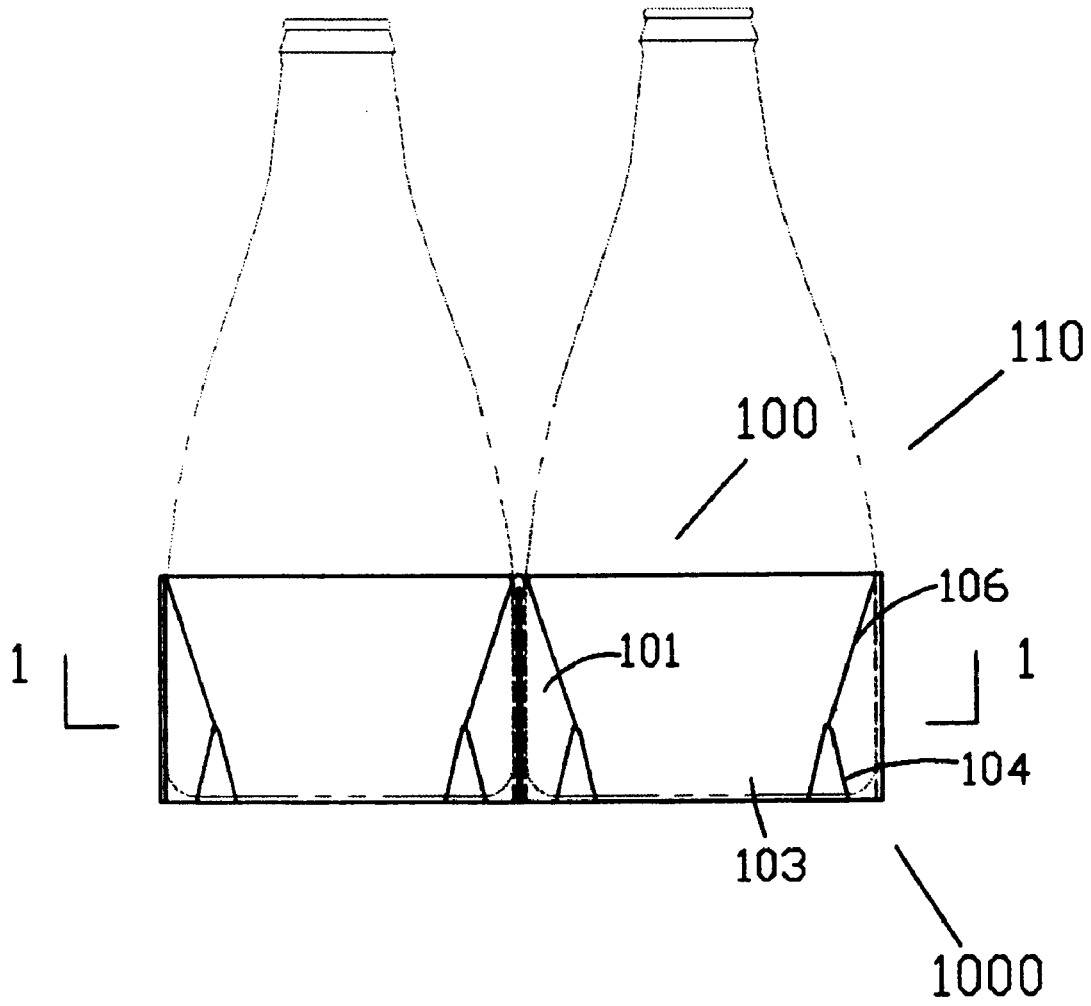
FIG. 3 is an elevation view of said short bottles placed vertically in said sleeves of FIGS. 1 and 2.

The tapered sleeves 100 of the group 1000 shown in FIGS. 1, 2 and 3 are each sufficient in height to enwrap the entire length of the cylindrical portions of bottles 110 which they were designed to separate and protect from injurious contact with each other. Each of said sleeves 100 is comprised of two side walls 101 at the interior of said group 1000, and two side walls 103 at the exterior of said group, said sleeves being connected together at adjacent side walls 101 by connecting bands 102. Each of said four side walls of each of said sleeves 100 has a wider width at its upper edge, the upper edges of said four side walls of each said sleeve together forming a square opening of sufficient dimension to allow free entry of the bottle 110 which it has been designed to receive. Each of said four side walls of each of said sleeves is tapered to a smaller width at its lower edge, in conformity with the taper of said sleeve.

At line 1—1 of FIG. 3 the total sum of the tapered widths of the four side walls at that location is only sufficiently greater than the circumference of said cylindrical portion of said bottle 110 to tolerate the required outwardly deflection of said side walls to conform with and encircle the exterior of said bottle 110. Below that level the connection together of said four side walls at their adjacent edges is discontinued at division lines 104, in order to allow the further outwardly deflection of the continuing lower portions of said side walls required to conform with the shape and size of the areas of said bottle contacted by said side walls.

Figure 4:
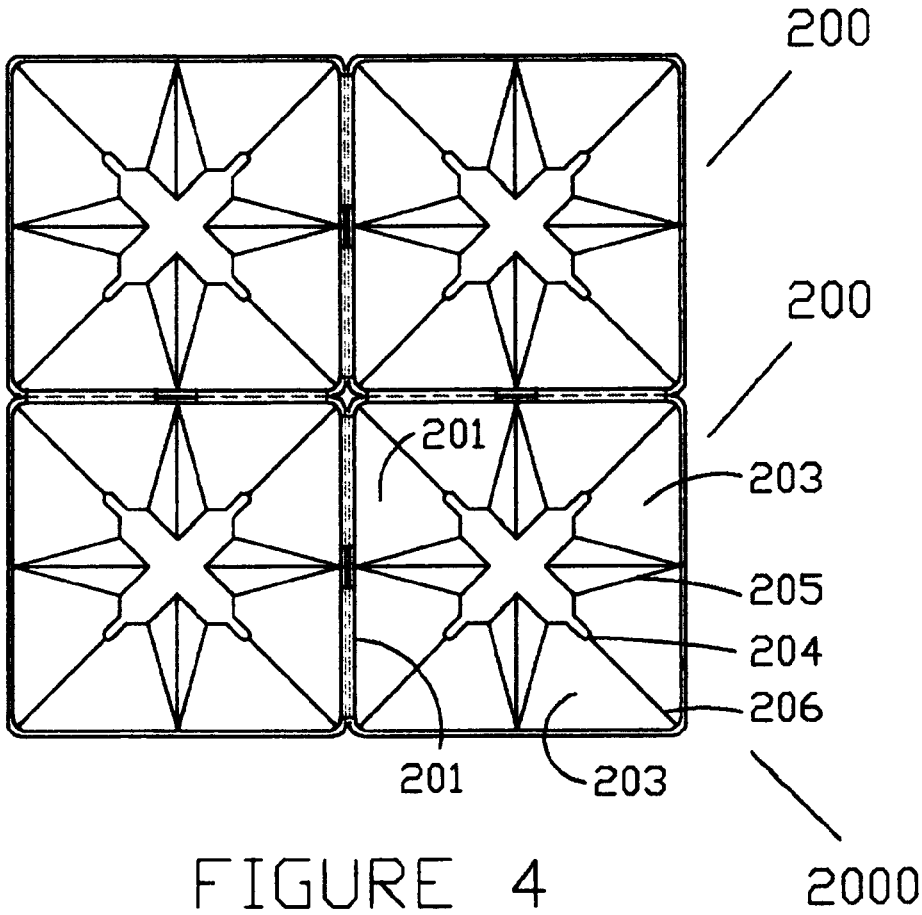
FIG. 4 is a plan view of a group of 4 elongated and interconnected sleeves designed to protect and retain in position 4 longer bottles placed vertically in a container.
Figure 5:
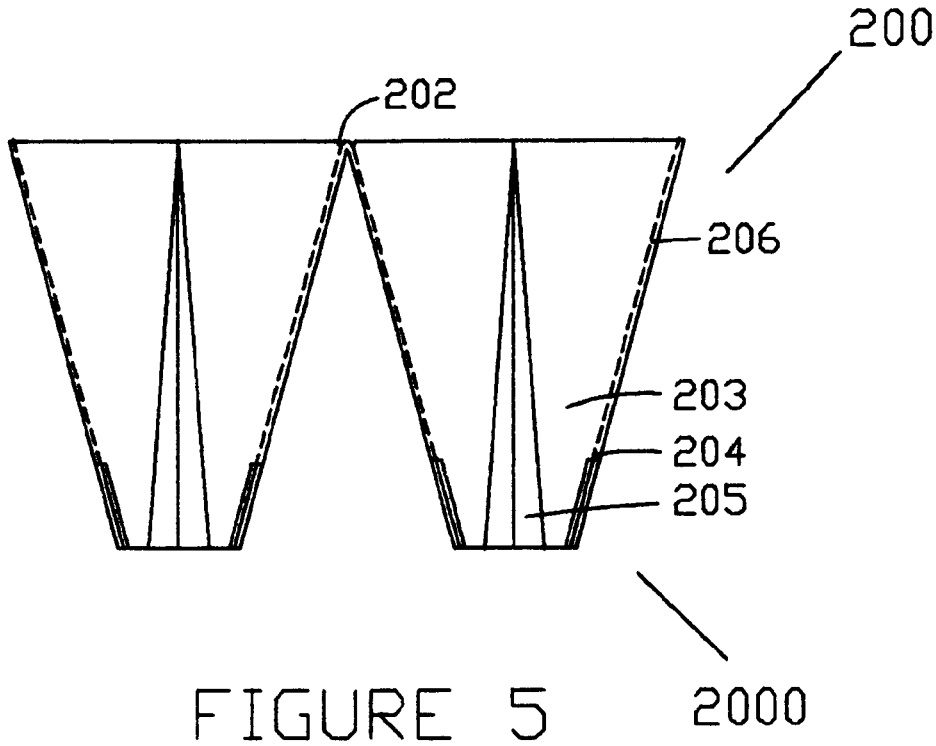
FIG. 5 is an elevational view of said group showing the tapered shape of said sleeves prior to the entry of said bottles.
Figure 6:
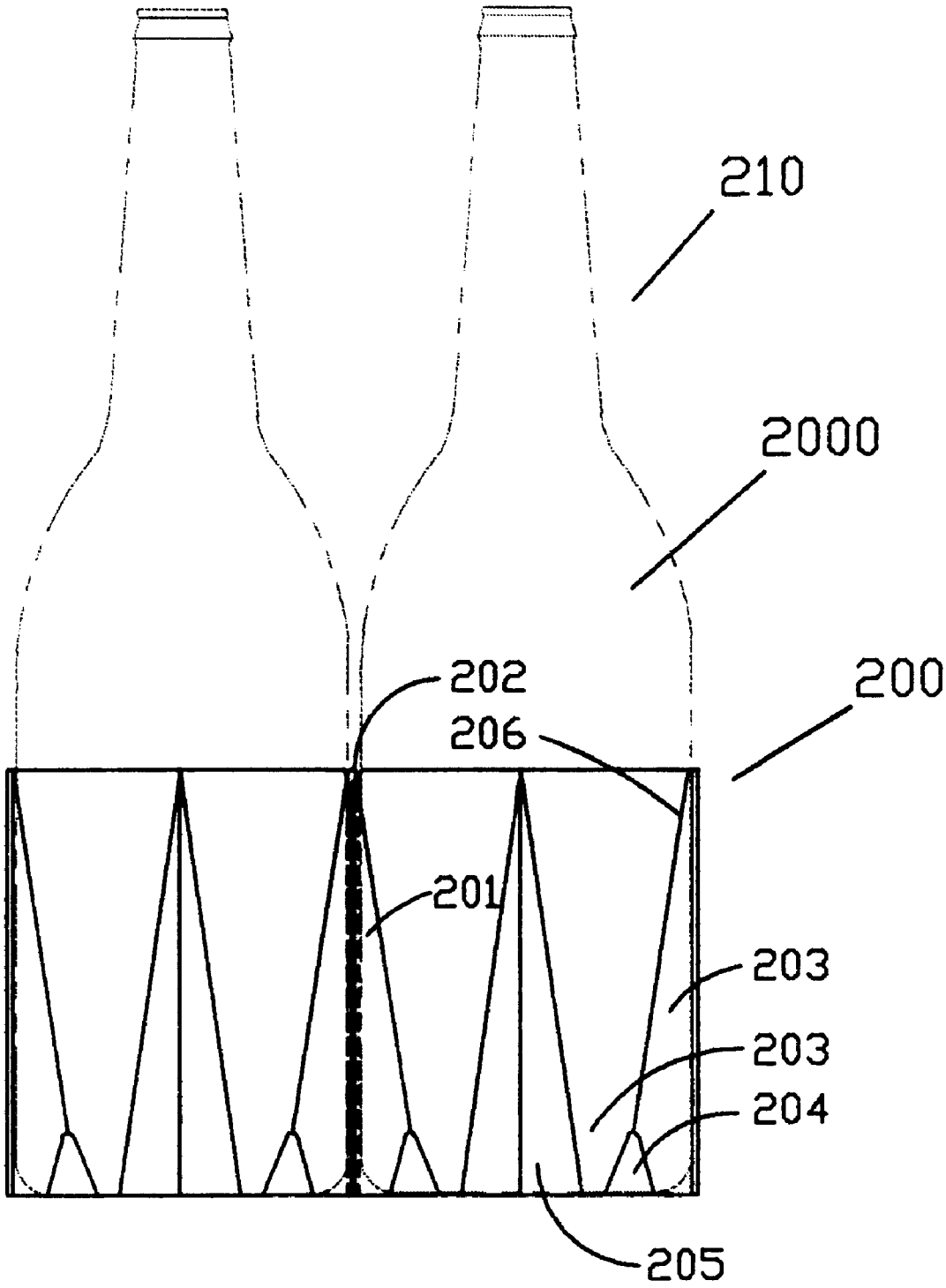
FIG. 6 is an elevational view of said longer bottles entered into said sleeves of FIGS. 4 and 5.

The tapered sleeves 200 of group 2000 shown in FIGS. 4, 5 and 6 are made sufficiently long to extend the entire length of the cylindrical portions of the longer bottles 210. The required continuing taper of said sleeves 200 in order to provide for nesting of said sleeves in storage necessitates special design features to stabilize the longer length of side wall portions disconnected from each other, and to provide a sufficient width of side wall material at the lower end of each said side wall to ensure protective separation of adjacent bottles. The shape and dimensions of an inwardly directed depression 205 formed in each of said side walls, and tapering from a minimum dimension at the upper edge of said side wall to a larger dimension at the lower edge thereof are shown in plan and elevation in FIGS. 4 and 5 respectively. Also shown are the optional division lines 204 indicating the length of disconnection, if required, between the edges of adjacent side walls at corners 206 in each of said sleeves. FIG. 6 is an elevational view showing bottles 210 already inserted in said sleeves 200 of said group 2000, and indicating said depressions 205 in said inner side walls 201 being pressed together to separate adjacent bottles 210 and said outer side walls 203 being stretched and further separated at said division lines 204 in order to conform with the shape of the exterior of said bottles at that location. Said depressions 205 also provide stabilizing column strength to each of said side walls 201 and 203 during the entry therein of said bottles 210.

Figure 7:
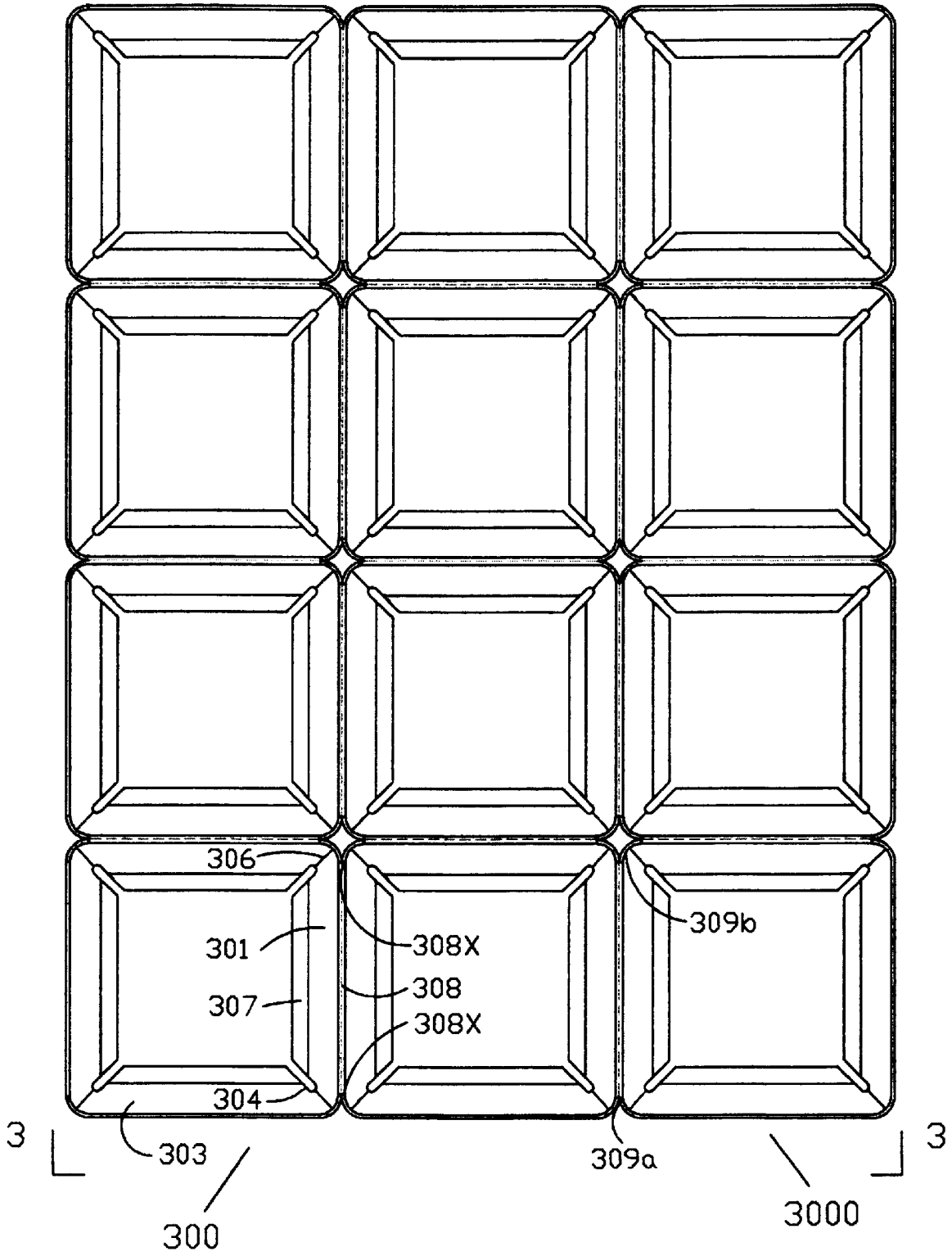
FIG. 7 is a plan view of an interconnected group of 12 of said tapered sleeves, each side wall of each said sleeves having been moulded with a stabilizing horizontal flange at the bottom end of said sleeve.

The system of bottle separators illustrated in FIGS. 7 through 12 requires the combined use of the group 3000 of sleeves 300 together with the panel 3500 of tapered cells 351, 352 and 353 and the container 4000. Shown in FIG. 7 is a plan view of said group 3000, comprised of twelve interconnected tapered cells 300, each of said cells 300 being comprised of four tapered side walls, each said side wall being moulded with an optional horizontal flange 307 at its lower edge. Adjacent side walls 301 are interior of said group and are connected together in pairs at lines 308. Side walls 303 together form the exterior side walls of said group 3000. Each said cell has an opening 354 in the top wall thereof.

The four side walls of each sleeve 300 each have an upper edge, and said four upper edges together form the rim of a square opening at the upper end of each said sleeve 300, the width of each said side wall being tapered in width from the width of said upper edge to a smaller width at its lower edge, to conform with the taper of the related sleeve. The connection together of the adjacent side walls of each said sleeve 300 at corners 306 is discontinued at separation lines 304 in order to permit the outward deflection of those disconnected portions of said side walls at the four corners of each said square opening whereby to widen the free space between said side walls at the upper ends thereof, and thereby to admit the entry of bottles of predetermined larger diameters at said rim of said square opening.

Each connecting line 308 between said side walls 301 is discontinued at lines 308X at each end thereof in order to allow the expansion of said square opening at the top of each said cell 300 in order to allow the entry of a bottle of larger diameter than the width and length of said square opening, thereby to permit the use of said group 3000 and said sleeves thereof to accommodate a limited range of bottles larger in diameter than the length or width of said square opening at the upper end of said sleeves.

Figure 8:
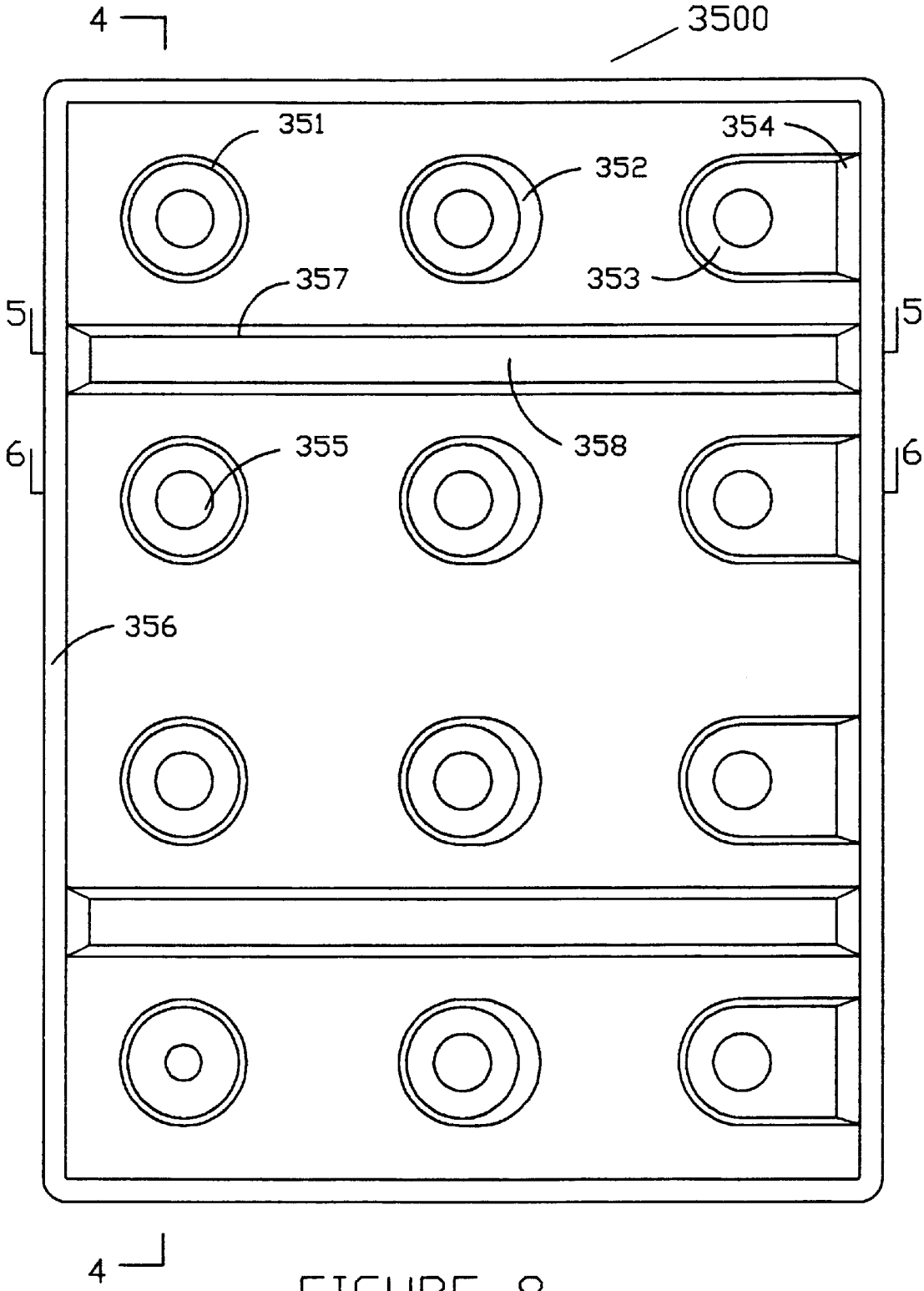
FIG. 8 is a plan view of a reinforced panel of tapered cells provided with two reinforcing ribs.
Figure 9:
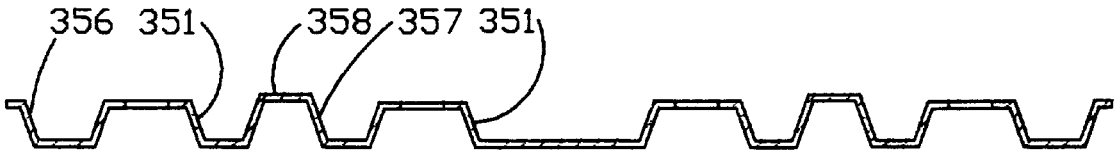
FIG. 9 is a cross-sectional view taken at line 4—4 of FIG. 8.
Figure 10:
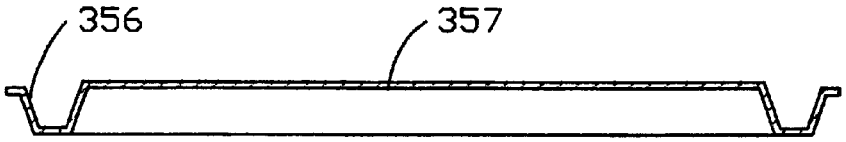
FIG. 10 is a cross-sectional view taken at line 5—5 of FIG. 8.
Figure 11:
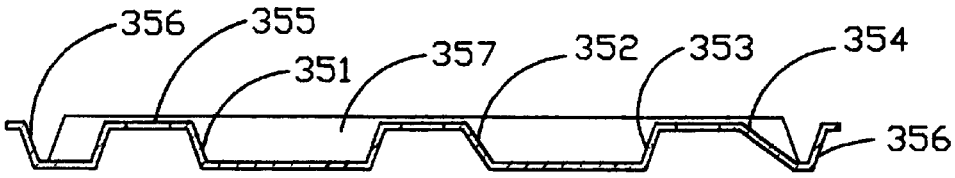
FIG. 11 is a cross-sectional view taken at line 6—6 of FIG. 8.
Figure 12:
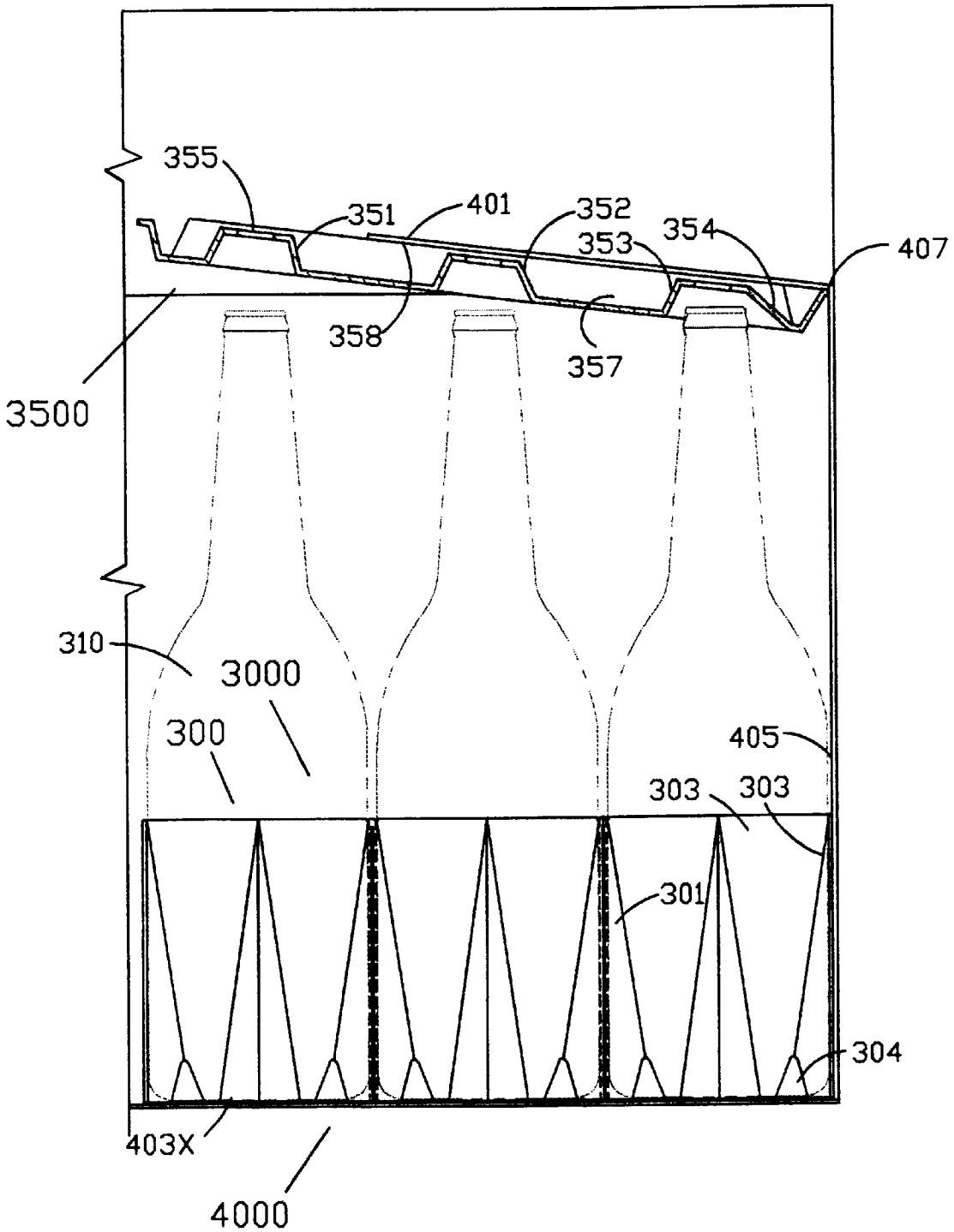
FIG. 12 is a cross-sectional view of bottles in a half portion of a container said bottles having been entered into said sleeves of FIG. 7.

Said panel 3500 is shown in plan view in FIG. 8, and is provided with two reinforcing ribs 357, each with a gluing face 358 for attachment to the inner face of an inner cover flap 401, said flap being hingedly connected to the upper edge of the end wall 405 of the container 4000, as shown in FIG. 12, said container being comprised of two side walls 406, two end walls 405, two inner bottom flaps 403, a bottom filler sheet 403X and two outer bottom flaps 404. Said panel 3500 is surrounded by a reinforcing flange 356 directed upwardly and outward from the connecting body of said panel, in order to facilitate the entry of said panel into said container. Each said panel 3500 is moulded with 12 tapered cells located to retain in position each of twelve said bottles 310, said cells being in three rows with four said cells in each row, a first row of cells 353 located nearest the hinge line 407 having an elongated taper 354 at the side nearest said hinge line 407 whereby to avoid obstructive contact between said adjacent side 354 and the top of a corresponding bottle 310 during the closing action of said inner cover flap 401. The four cells 352 in the intermediate row of cells have an extended taper at the side nearest said hinge line 407 designed to retain said top of the related bottle 310 when said inner cover flap 401 is in the closed position, and each cell of the row of four cells 351 nearest the outer edge of said panel 3500 has a uniform taper designed to retain the corresponding bottle tops in their intended positions.

What is claimed is:

1. Resiliently expandable sleeves, tapered to facilitate nesting in storage, and moulded from paper pulp or recycled waste papers, a multiplicity of which can be assembled into a closely connected group of sleeves for the positioning and protective separation from each other of articles placed vertically and closely spaced in a container, each said sleeve being comprised of four side walls of similar shape and dimensions, each tapered from a wider width at its upper end to a lesser width at its lower end, said four side walls of each said sleeve being connected together at a predetermined portion of the length their adjacent edges to form the tapered tubular form of said sleeve, said four upper edges of said side walls of each said sleeve forming the rim of a square opening designed to provide free entry of said article, each of said side walls being designed to deflect outwardly of said sleeve, to permit the further entry of one of said articles into said sleeve to a point in the length of said sleeve where the total internal connected circumference thereof is approximately equal to, but not less than, the circumference required to accommodate the size and shape of the article to be entered therein, and beyond that point the connections between said adjacent edges of said side walls are discontinued to permit the required further entry of said article into said sleeve, the upper ends of adjacent sleeves being connected together at the upper edges of adjacent side walls thereof, when required to form a closely interconnected group of said sleeves.

2. The group of sleeves of claim 1 where a horizontal flange is attached to the lower edge of the disconnected portion of each of said four side walls of each of said sleeve.

3. The group of sleeves of claim 1 where each said connection between said upper edges of said adjacent side walls of adjacent sleeves is discontinued adjacent each corner of each square opening at the upper end of each said sleeve for a predetermined distance at the corresponding side of said opening, thereby to permit the expansion of said square opening by the deflection of the upper ends of said side walls at said corners of said square opening, thereby to permit the entry into the upper end of said sleeve by a bottle of larger diameter.

4. The group of sleeves of claim 1 where each of said four tapered side walls is formed with a tapering depression directed inwardly of said sleeve, and extending downwardly along the entire length of said side wall from a minimum dimension at the upper end of each said side wall to a maximum dimension at the lower end thereof.

5. A bottle pack to contain a multiplicity of bottles placed vertically in a container, said bottle pack being comprised of a container with a top wall comprised of two hinged inner cover flaps and two hinged outer cover flaps, together with at least one group of sleeves of claim 1 to position and protectively separate the lower ends of said bottles from each other, and two reinforced panels formed with a multiplicity of tapered cells, each of said panels being formed with a sufficient number and appropriate location of said cells to entrap and position the upper ends of one half the number of said bottles to be packed in said container, each said panel being formed with two reinforcing ribs, each of said ribs having a gluing face for attachment to the inner face of one of said two inner cover flaps of said container.

* * * * *